United States Patent [19]

Hale, Jr.

[11] Patent Number: 4,760,872

[45] Date of Patent: Aug. 2, 1988

[54] SECURITY PET DOOR

[76] Inventor: Seymour B. Hale, Jr., 5220 W. Acapulco La., Glendale, Ariz. 85306

[21] Appl. No.: 31,565

[22] Filed: Mar. 30, 1987

[51] Int. Cl.[4] ..... E06B 3/32

[52] U.S. Cl. ..... 160/90; 160/180; 49/168; 49/169

[58] Field of Search ..... 160/90, 180, 116, 87, 160/90, 89, 354, 368 R, 370, 369, 92; 49/168, 169, 170, 171

[56] References Cited

U.S. PATENT DOCUMENTS

| | | | |
|---|---|---|---|
| 2,758,646 | 8/1956 | Johnson | 160/354 |
| 3,464,158 | 9/1969 | Greene | 49/168 |
| 3,626,507 | 12/1971 | Hawkins | 292/175 |
| 3,797,554 | 3/1974 | Johnson | 160/354 |
| 3,811,224 | 5/1974 | Garrison | 49/168 |
| 4,043,079 | 8/1977 | Smith | 49/169 X |
| 4,047,331 | 9/1977 | Davlantes | 49/171 |

*Primary Examiner*—Ramon S. Britts

*Assistant Examiner*—David M. Purol

*Attorney, Agent, or Firm*—Cahill, Sutton & Thomas

[57] ABSTRACT

A security pet door for mounting in a glass door or window includes a mounting element made up of H-shaped channel members, and a flap member mounted for swinging movement in said mounting element. An intermediate horizontal edge of the glass pane of the door or window is received in the upwardly opening portion of the top channel member of the mounting element, and an intermediate vertical edge of the glass pane is received in the outwardly opening portion of one of the side channel members. In addition, the outwardly opening portion of the other side channel member and the downwardly opening portion of the bottom channel member are provided with inserts for projecting into the frame of the pane. The pet door also includes a receiver element attached to the indoor side of the mounting element for receiving a removable security panel which prevents unwanted intruders from entering through the door.

7 Claims, 2 Drawing Sheets

SECURITY PET DOOR

BACKGROUND OF THE INVENTION

1. Field of the Invention

This invention relates in general to pet doors and, more particularly, to a lockable pet door for installation in a glass patio-type door or window.

2. Background of the Invention

Many pet owners, aggravated by the necessity of having to wake up at odd hours of the night or being interrupted in the middle of household chores in order to allow their pets into or out of the house, find it convenient to install pet doors which allow their cats, dogs or other domestic pets to freely come and go at will. Pet doors of two basic types are known. The first type of pet door comprises a simple, downwardly hanging flap of suitable material installed in a conventional wooden door. This type of pet door is generally satisfactory, except that very often conventional wooden doors are found only in the front portion of the house, where they let out directly onto the street or an unfenced front yard, from which the pet could very easily wander away and get lost, injured, or stolen. For this reason, many people prefer a second type of pet door, which can be installed in a glass door of the type which usually lets out onto a fenced-in deck, patio or backyard area.

Glass patio-type doors generally comprise a pair of panels, including a sliding panel and a stationary panel, each of which consists of a pane of glass having its edges received in a rectangular frame. The frame of the stationary panel is fixed in one side of the doorway, while the frame of the sliding panel is mounted on a track which allows it to be slid from an open position in which it overlies the stationary panel to a closed position in which it covers the other side of the doorway. When the sliding panel is in the closed position, one edge of its frame slightly overlaps the frame of the stationary panel. This edge is provided with a specially formed flange which interlocks with a mating flange provided on the frame of the stationary panel, thus preventing an intruder from lifting the panels sliding out of its track and breaking into the house.

A commonly available pet door for installation in the above-described patio-type door requires that the sliding panel of the door be moved into a partially open position, creating a gap between it and the side wall of the doorway. An adapter panel of plastic or other suitable material is then inserted into this gap to block out drafts and the like. The lower portion of this adapter panel is provided with a downwardly hanging flap of material which allows a pet to pass in and out of the door in much the same manner as in the first type of pet door. One problem with this second type of pet door, however, is that because the sliding panel of the main door remains in a partially open position, the door cannot be locked in the usual manner and the specially formed flange on the edge of its frame is disengaged from the mating flange on the edge of the stationary panel. This makes it easy for an intruder to remove the panel and enter the house. In addition, the adapter panel is unattractive, difficult to store when not in use and destroys the symmetrical appearance of the patio door. Still further, the adapter panel often is not well sealed in the doorway, thus allowing relatively hot or cold outside air to enter the house and increasing household energy costs.

A need exists, therefore, for a new and improved security pet door which overcomes some of the problems and shortcomings of the prior art doors.

SUMMARY OF THE INVENTION

In accordance with the present invention, a new and improved security pet door is provided for installation in any fixed or movable glass door or window.

The security pet door comprises a substantially rectangular mounting element or frame for installation in a cutout one of the lower corners of a glass door or window. The mounting element is made up of a plurality of H-shaped in cross section channel members, including a top channel member, a bottom channel member, and a pair of spaced apart side channel members extending from opposite ends of the top and bottom channel members. The upwardly opening portion of the top channel member receives a lower edge of the glass pane which defines the top of the cutout corner of the door or window, while the outwardly opening portion of one of the side channels receives a side edge of the pane which defines the side of the cutout corner thereof. The outwardly opening portion of the other side channel member and the downwardly opening portion of the bottom channel member each receive an elongated inset member which projects into one of the U-shaped channels which make up the main door or window frame.

A flap member, which is preferably made of a sheet of durable yet lightweight and flexible and preferably transparent material such as plastic, fills substantially the entire interior portion of the mounting element. The top edge of the flap is received in the downwardly opening portion of the top channel member of the mounting element and secured therein, and the bottom and side edges of the flap are free. Thus, the flap is able to swing outwardly and inwardly with respect to the mounting element in response to a push from an outgoing or incoming pet. A pair of metallic clips are secured to the bottom corners of the flap, and a magnet is provided in the upwardly opening portion of the bottom channel of the mounting element directly below each of the metallic clips, thus causing the flap to swing back to a straight down position after being pushed outwardly or inwardly and to be retained there by means of the magnetic force. In addition, a strip of sealing material is provided in the inwardly opening portions of each of the side channels and between the two magnets in the bottom channel in order to inhibit cold air and the like from passing between the flap and the mounting element.

A receiver element is secured to the indoor face of the mounting element for holding a removable security panel in an overlaying position in front of the flap. The receiver element preferably comprises a set of three U-shaped channel members, including a U-shaped bottom channel member integrally formed or suitably attached to the H-shaped bottom channel member of the mounting element, and a pair of U-shaped side channel members, each of which is integrally formed or suitably attached to a different one of the H-shaped side channel members of the mounting element. The top end of the receiver element opposite the bottom channel member is open to allow the security panel to be slidably inserted and removed. The security panel, which comprises a sheet of rigid unbreakable material such as polycarbonate, may be inserted whenever it is necessary to prevent passage through the door, such as when the pet owners are away from home. Thus, unwanted intruders such as burglars and wild animals are prevented from crawling in through the pet door. In addition, a locking device is provided on the receiver element for locking the security panel in place. A finger hole may be provided at the top of the panel for facilitating removal when the locking means is disengaged. Preferably, the security panel is tinted a color which stands out against the window pane and the flap member making it highly visible. This will prevent the pet from mistakenly thinking that the door is open and consequently, trying to run through and banging its head.

Accordingly, it is an object of this invention to provide a new and improved security pet door which can be mounted in a glass door or window.

Another object of the invention is to provide a pet door with a removable security panel to prevent passage through the door when the panel is in place.

Still another object of the invention is to provide a security pet door with a mounting element, a flap mounted for swinging movement in the frame, and means for retaining the flap in a straight down position except when a pet is passing through.

The foregoing and other objects of the present invention, as well as the invention itself, may be more fully understood from the following description when read in conjunction with the accompanying drawings.

DESCRIPTION OF THE PREFERRED EMBODIMENT

Figure 1:
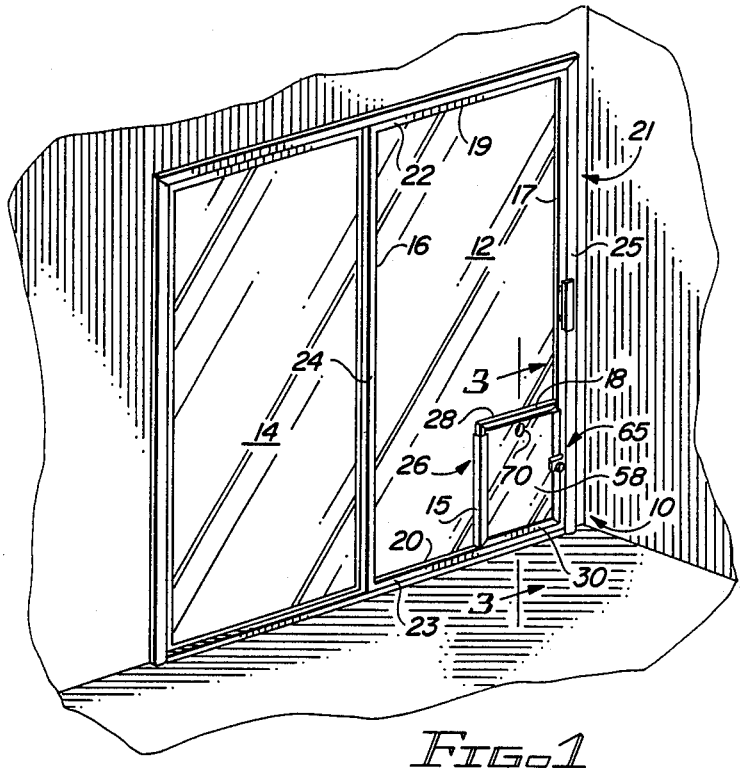
FIG. 1 is a perspective view from the interior of a house showing the pet door of the present invention installed in sliding glass patio-type door.
Figure 2:
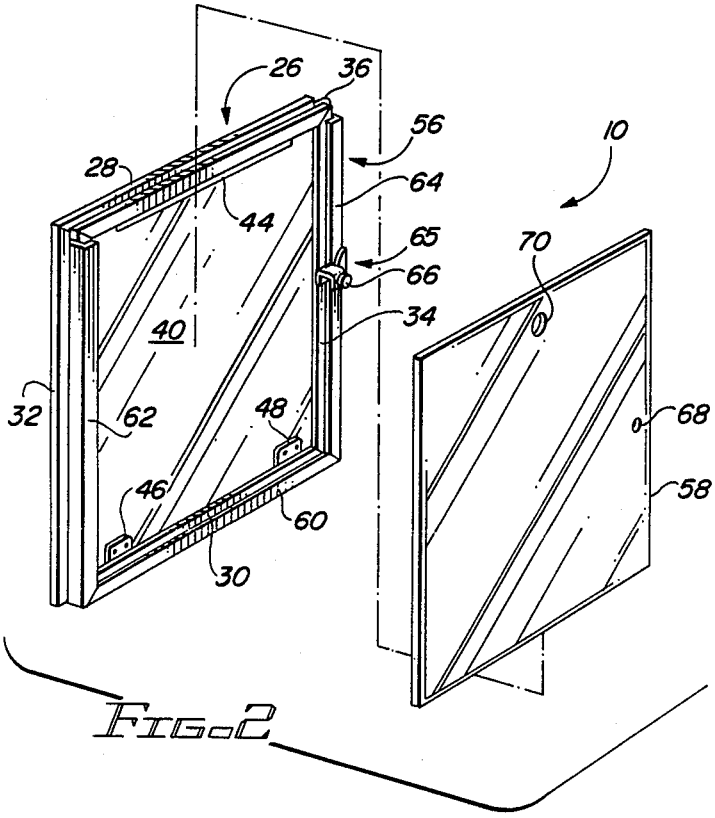
FIG. 2 is a perspective view of the pet door of the present invention with the removable security panel being shown in exploded relationship to the frame and flap member.

Referring more particularly to the drawings, FIG. 1 shows the pet door of the present invention, indicated in its entirety by the numeral 10, installed in the sliding panel 12 of a glass patio door. However, the pet door 10 could also be installed in the stationary panel 14 of the door, or in any other type of glass door or window. In general, the panel 12 is formed from a rectangular pane of tempered glass which has had one of its lower corners removed. The removed corner portion defines an intermediate vertical edge 15 parallel to the spaced apart side edges 16, 17 of the panel 12, and an intermediate horizontal edge 18, parallel to the top and bottom edges 19, 20 of the panel 12. The panel 12 is encased in a rectangular frame 21 which as customary in the art, comprises a U-shaped top channel member 22 for receiving the top edge 19 of the panel 12, a U-shaped bottom channel member 23 for receiving the bottom edge 20 of the panel 12, and a pair of spaced apart U-shaped side channel members 24, 25, each for receiving a different one of the side edges 16, 17 of the panel.

The pet door 10, which can be manufactured in a variety of sizes to accommodate different sizes of pets, comprises a substantially rectangular mounting element or frame 26 for installation in place of the cutout lower corner of the glass panel 12. The mounting element 26 defines a passageway through the panel 12 and is made up of a plurality of H-shaped in cross section channel members, including a top channel 28, a bottom channel 30, and a pair of spaced apart side channels 32, 34 extending from opposite ends of the top and bottom channels 28, 30. Each channel member is secured at right angles to the adjacent channel members by means of any suitable fastener, such as by L-shaped spring clips 35. The upwardly opening portion of the H-shaped top channel 28 receives the intermediate horizontal edge 18 of the glass panel 12, while the outwardly opening portion of one of the H-shaped side channels 32 receives the intermediate vertical edge 15 of the panel 12. The outwardly opening portion of the other H-shaped side channel 34 holds an elongated, rigid first insert member 36 which projects into one of the U-shaped side channel members 25 of the frame 21 of the glass panel 12. Similarly, the downwardly opening portion of the H-shaped bottom channel 30 holds an elongated, rigid second insert member 38 which projects into the U-shaped bottom channel member 23 of the frame 21.

Figure 5:
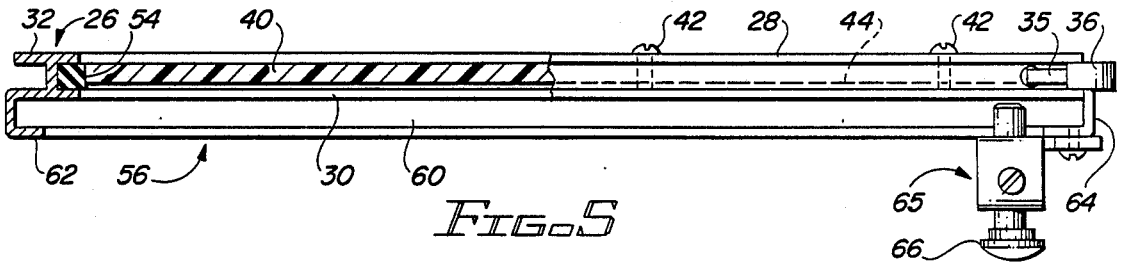
FIG. 5 is a sectional view taken through line 5—5 of FIG. 4.
Figure 6:
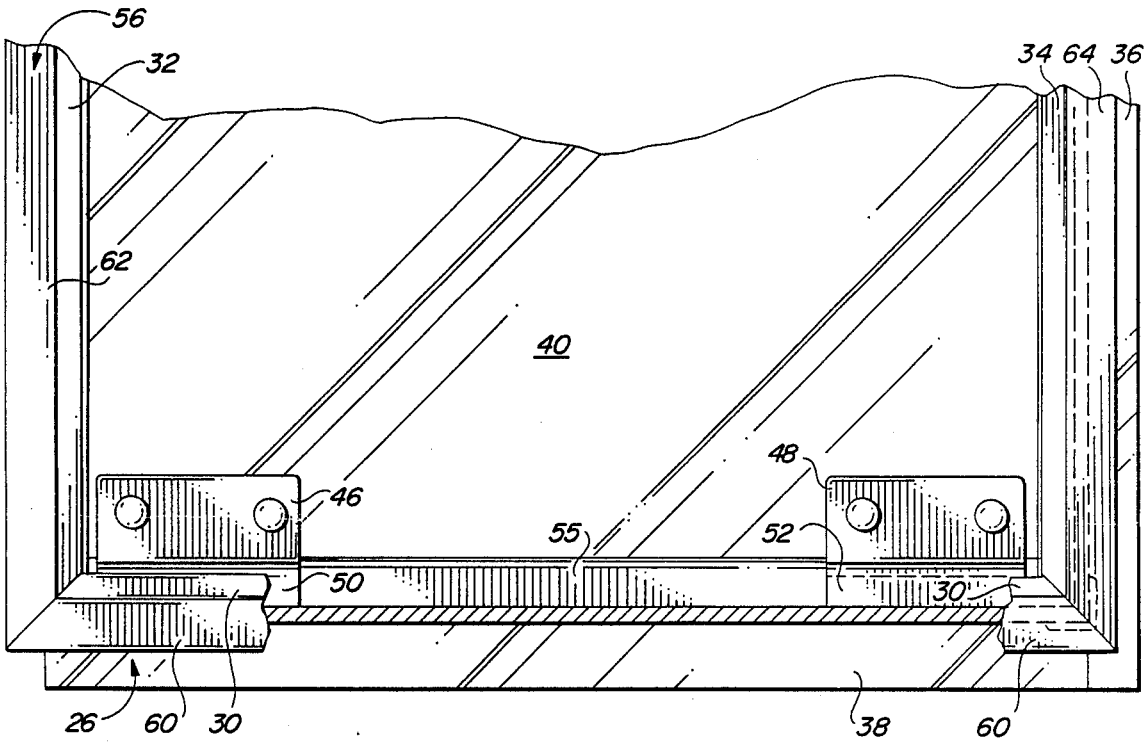
FIG. 6 is a fragmentary front view, partially broken away, showing the bottom of the frame of the pet door.

A flap member 40, which is preferably made of a sheet of durable yet lightweight and flexible transparent material such as plastic, fills substantially the entire interior portion of the mounting frame 26. The top edge of the flap member is preferably secured by means of suitable fasteners such as screws 42 to a nut plate 44 which is received in the downwardly opening portion of the top H-shaped channel 28 of the mounting element 26 and secured therein by means of the screws 42. The side and bottom edges of the flap 40 are free for swinging movement in and out of the mounting element 26 when the flap 40 is pushed with sufficient force, the flap 40 is normally retained in a stationary, straight down position by means of a pair of spaced apart metallic clips 46, 48 provided on the bottom edge of the flap 40, and a pair of magnets 50, 52 provided in the upwardly opening portion of the H-shaped bottom channel 30 of the mounting element directly beneath the clips 46, 48. The attraction between the magnets 50, 52 and the clips 46, 48 causes the flap 40 to stop swinging after a pet has passed through, and to retain the flap 40 in a straight down position despite small magnitude forces such as gusts of wind and the like. In addition, a strip of sealing material 54 (only one shown in FIG. 5) is provided in the inwardly opening portion of each of the H-shaped side channels 32, 34 of the mounting element 26 in order to prevent unwanted air and the like from passing between the flap 40 and the mounting element 26. Another strip of sealing material 55 inserted in the upwardly opening portion of H-shaped bottom channel 30 between the two magnets 50, 52 in order to prevent unwanted air movement underneath the flap 40.

A receiver element 56 is preferably formed integral with, but may optionally be secured to the indoor face of the mounting frame 26 for holding a removable security panel 58, preferably made from a sheet of rigid unbreakable material such as polycarbonate, in inwardly overlaying relationship with the flap 40. The receiver element 56 preferably comprises a set of three U-shaped channel members, including a U-shaped bottom channel member 60 integrally formed or attached to the H-shaped bottom channel member 30 of the mounting element 26, and a pair of U-shaped side channel members 62, 64, each of which is integrally formed or suitably attached to a different one of the H-shaped side channel members 32, 34 of the mounting element 26. The top end of the receiver element 56 opposite the bottom channel member 60 is open to allow the security panel 58 to be slidably inserted and removed.

Figure 3:
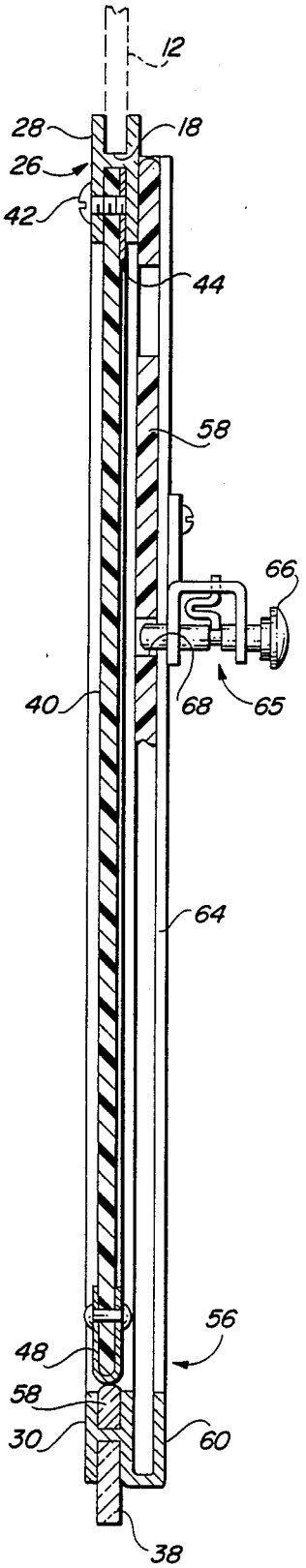
FIG. 3 is an enlarged sectional view taken through line 3—3 of FIG. 1.
Figure 4:
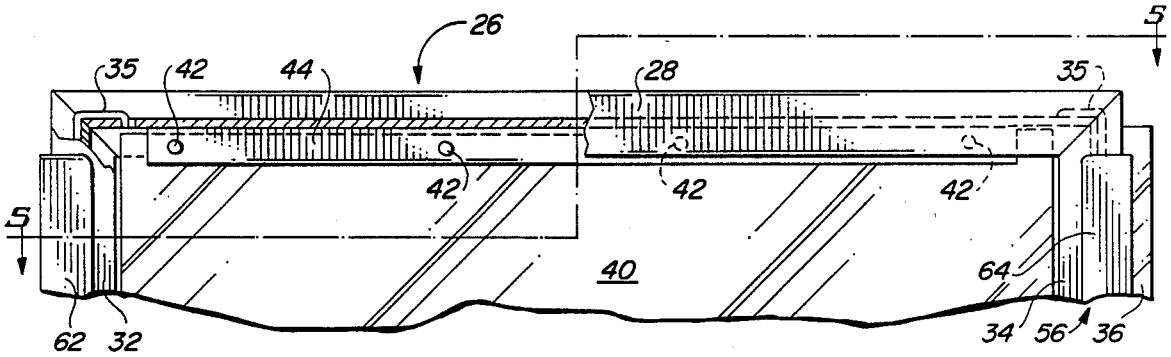
FIG. 4 is a fragmentary front view partially broken away, showing the top of the frame of the pet door.

In order to prevent the security panel 58 from being removed by an intruder outside the window 12, the receiver element 56 includes locking means 65 such as the reciprocable, spring-biased locking pin 66 of the type described in U.S. Pat. No. 3,626,507. To lock the panel 58 in place, it is simply necessary to press the pin 66 inwardly so that it is received in an aperture 68 provided in the security panel, as shown in FIG. 3. In order to release the panel, it is necessary to pull the pin 66 outwardly, out of engagement with the aperture 68. In addition, a second, larger aperture 70 is provided in the central top portion of the security panel 58 to define a fingerhold for facilitating lifting and removal of the panel 58. The security panel 58 is preferably tinted a color which contrasts with the glass pane 12 in order to prevent a pet from attempting to walk through when the panel is in place.

While the principles of the invention have now been made clear in the illustrated embodiment, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A pet door assembly comprising, in combination:

(a) a rectangular pane of glass having a top edge. a bottom edge, and a pair of spaced apart opposite side edges, said pane having had a rectangular portion removed from one of its lower corners to define an intermediate vertical edge parallel to the spaced apart side edges of said pane, and an intermediate horizontal edge parallel to the top and bottom edges of said pane;

(b) a rectangular frame for surrounding said pane, said frame including:

(i) a U-shaped top channel for receiving said to edge of said pane, (ii) a U-shaped bottom channel for receiving said bottom edge of said pane, and (iii) a pair of spaced apart U-shaped side channels for receiving said side edges of said pane;

(c) a rectangular mounting element for attachment to said panel, said mounting element defining a passageway and including, (i) an H-shaped in cross section top channel member having an upwardly opening portion in which said intermediate horizontal edge of said glass pane is mounted and a downwardly opening portion which faces into the passageway of said mounting element, (ii) an H-shaped in cross section bottom channel member having an upwardly opening portion which faces into the passageway of said mounting element and a downwardly opening portion, (iii) a first H-shaped in cross section side channel member, said first H-shaped side channel member having an outwardly opening portion in which the intermediate vertical edge of said glass pane is mounted and an inwardly opening portion which faces into the passageway of said mounting element, (iv) a second H-shaped in cross section side channel member, said second H-shaped side channel member having an outwardly opening portion and an inwardly opening portion which faces into the passageway of said mounting element, (v) a first insert member mounted in the outwardly opening portion of said second H-shaped side channel member and projecting into one of said pair of U-shaped side channel members of said frame, and (vi) a second insert member mounted in said downwardly opening portion of said H-shaped bottom channel member and projecting into said U-shaped bottom channel member of said frame; and (d) a rectangular flap member mounted for swinging movement in said mounting element to selectively provide and block access through the passageway defined thereby, said flap member having a top edge mounted in the downwardly opening portion of said H-shaped top channel member of said mounting element, and free bottom and side edges.

2. The pet door of claim 1, further comprising means for preventing unwanted intruders from entering through said pet door, said means comprising:

(a) a receiver element on the indoor side of said mounting element, said receiver element including:

(i) a U-shaped bottom channel member integrally with the indoor side of said H-shaped bottom channel member of said mounting element; and (ii) a pair of U-shaped channel members, each of which is integrally with the indoor side of a different one of said H-shaped side channel members of said mounting element, each of said H-shaped side channel members being open at its top ends of said security panel;

(b) a removable security panel for slidable insertion into said receiver element; and (c) locking means releasable only from the indoor side of said pet door for locking said security panel in place.

3. The pet door of claim 2, in which said locking means comrpises:

(a) a spring-biased reciprocable locking pin mounted on the indoor side of one of said H-shaped side channel members of said receiver element; and (b) an aperture formed in said security panel for receiving said locking pin.

4. The pet door of claim 2, further comprising means for normally retaining said flap member in a stationary position blocking access through said passageway.

5. The pet door of claim 4, in which said means for normally retaining said flap member in a stationary position comprises:

(a) a pair of metallic clips, each clip being secured to a different bottom corner of said flap member; and (b) a pair of magnets mounted in said upwardly opening portion of said H-shaped bottom channel of said mounting element, each magnet being located directly below a different one of said metallic clips.

6. The pet door of claim 5, further comprising sealing means for minimizing leakage of air between said flap member and said mounting element when said flap member is in said stationary position.

7. The pet door of claim 6, in which said sealing means comprises:

(a) a strip of sealing material in the inwardly opening portions of each of said H-shaped side channel members of said mounting element; and (b) a strip of sealing material located between said magnets in said upwardly opening portion of said H-shaped bottom channel member of said mounting element.

* * * * *